United States Patent [19]

Maier

[11] 4,429,849

[45] Feb. 7, 1984

[54] FRAME FOR SETTING UP THE LINES PREPARATORY TO ERECTION OF BUILDINGS OR THE LIKE

[76] Inventor: Josef Maier, Schwimmbadstr. 3, D-7611 Steinach, Fed. Rep. of Germany

[21] Appl. No.: 208,408

[22] Filed: Nov. 19, 1980

[30] Foreign Application Priority Data

Nov. 30, 1979 [DE] Fed. Rep. of Germany ..... 2948230

[51] Int. Cl.[3] ..... A45F 3/44

[52] U.S. Cl. ..... 248/156; 52/155

[58] Field of Search ..... 248/156, 545, 533, 85, 248/86, 125, 121; 52/155, 158, 159

[56] References Cited

U.S. PATENT DOCUMENTS 2,612,695 10/1952 Schneider ..... 248/156 X
2,851,823 9/1958 Peterson ..... 248/156 X
3,479,071 11/1969 Downing ..... 248/547 X

FOREIGN PATENT DOCUMENTS 2202131 7/1973 Fed. Rep. of Germany ..... 52/155
1037550 7/1966 United Kingdom ..... 52/155

*Primary Examiner*—Ramon S. Britts
*Assistant Examiner*—Sarah A. Lechok
*Attorney, Agent, or Firm*—Kontler, Grimes & Battersby

[57] ABSTRACT

A peg which forms part of a frame for setting up the lines around excavations preparatory to erection of buildings or the like has a post the lower end of which is provided with a laterally extending plate welded to the web of a U-shaped leg whose flanges have aligned openings for the shank or shanks of one or more nails which are driven into the ground at an acute angle to the axis of the post. A second U-shaped leg is welded to the lower end of an inclined brace which is adjustably coupled to an intermediate portion of the post. A third U-shaped leg can be connected to the outer ends of two reinforcing members whose inner ends are integral with the post. Additional openings for the shanks of nails can be provided in the webs of the legs.

31 Claims, 5 Drawing Figures

2
12
20
22
18
23
20
21
19
16
10
11
14
2a
13
7
10
10'
15
11
7
8
9
10'
14
10
8
11
7
10
10'
9
14

FRAME FOR SETTING UP THE LINES PREPARATORY TO ERECTION OF BUILDINGS OR THE LIKE

BACKGROUND OF THE INVENTION

The present invention relates to a frame or an analogous apparatus for setting up the lines prior to proceeding with excavation at the sites for erection of buildings or the like.

Frames for so-called setting up of the lines are used by builders, contractors, masons, operators of earth moving equipment or house owners to outline the area which is to be dug up preparatory to laying of foundations or for analogous purposes. As a rule, the lines in the form of cords or ropes are secured to nails which are driven into laths or boards supported by pegs at the corners of the proposed excavation site. The pegs are secured to the ground by suitable nails. The present invention deals with the construction and mounting (securing) of pegs which can be used to support panels, batter boards, laths, strips, beams or analogous carriers of devices (such as nails) for connection to ropes, cords, wires, bands or similar flexible elements for confinement of the area which is to be dug up by machines, by manually operated tools or both.

The aforementioned pegs must be secured to the ground with a relatively high degree of reliability. As a rule, there are three upright or nearly upright pegs at each corner of the proposed excavation site. If the mounting of the pegs is unsatisfactory, the lines are likely to be shifted. Also, accidental overturning of improperly assembled and/or fastened pegs will necessitate lengthy and costly interruption of the excavating operation.

The reliability of securing of pegs to the ground depends, to a considerable extent, on the composition and/or configuration of the ground at the proposed construction site. In accordance with a presently known proposal, the peg includes an upright post which is propped by at least one brace. The brace is adjustable, as considerable in the axial direction of the post. The free end (i.e., the lower end) of each brace has a tubular leg which is inclined (or can be inclined) relative to the axis of the brace and can be secured to the ground by a nail whose shank extends through the axial passage of the leg and is driven into the ground. If a piece of rock or the like is located below the lower end of the tubular leg, the latter cannot be secured to the ground or the connection with the ground is weak and hence unreliable. If the tip of the nail slides along a relatively hard obstruction in the ground, the inclination of the peg is changed accordingly. Therefore, the just described conventional peg normally employs several braces to increase the likelihood of adequate connection between the ground and at least one of the braces.

OBJECTS AND SUMMARY OF THE INVENTION

An object of the invention is to provide a novel and improved frame for setting up the lines preparatory to digging at the proposed building sites or the like.

Another object of the invention is to provide a novel and improved peg for batter boards or the like.

A further object of the invention is to provide novel and improved means for securing a peg to the ground in any one of a practically infinite number of positions or inclinations.

An additional object of the invention is to provide a peg which can be properly secured to flat, sloping or otherwise configurated ground in a simple and time-saving manner.

Another object of the invention is to provide a simple, inexpensive and highly reliable arrangement for securing the pegs of a frame which is used to set up the lines surrounding an excavation site or a proposed excavation site.

Still another object of the invention is to provide novel and improved ground-contacting legs for use on or in combination with a peg of the above outlined character.

An additional object of the invention is to provide a peg which can be used on stony, rocky, soft or hard ground and which can be secured to such ground by simple, inexpensive and reusable fasteners.

Another object of the invention is to provide a peg which can be used as a superior substitute for heretofore known pegs in frames for setting up of lines which surround or are about to surround an excavation in the form of a hole, trench, groove or the like.

The invention resides in the provision of a so-called peg which can be used in a frame of setting up the lines preparatory to excavation at building sites or the like. The peg comprises an elongated post, at least one substantially U-shaped leg which serves to connect the post to the ground and includes a web between two flanges each of which has at least one opening, and means for securing the leg to the ground including at least one nail having a shank extending through at least one of the openings and into the ground. The leg can be connected to the lower end of the post or to a first portion of a brace a second portion of which is preferably adjustably and/or separably coupled to an intermediate portion of the post. The peg can comprise at least two legs, one on or at the lower end of the post and another on the first portion of the brace. One or more additional openings for the shanks of nails can be provided in the web or webs of one or more legs. The leg or legs can be welded or bonded or permanently secured to the lower end of the post and/or to the brace.

The flanges of each leg have edge faces which are preferably remote from the brace or from the post, i.e., the web of the corresponding leg is nearer to the post or to the brace than the edge faces of the respective flanges.

The post is normally upright or nearly upright when the leg or legs are connected to a piece of ground which has a substantially horizontal surface. The flanges of the leg or legs can be disposed in planes which are substantially parallel to or make an oblique angle with such horizontal surface. The web of a leg is or can be connected to an end of the post or to an end portion of the brace in such a way that at least a portion of the web extends (laterally or otherwise) beyond the end of the post or beyond the end portion of the brace. The aforementioned additional opening or openings are provided in such portion or portions of the web or webs.

The novel features which are considered as characteristic of the invention are set forth in particular in the appended claims. The improved peg itself, however, both as to its construction and the mode of assembling and installing the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
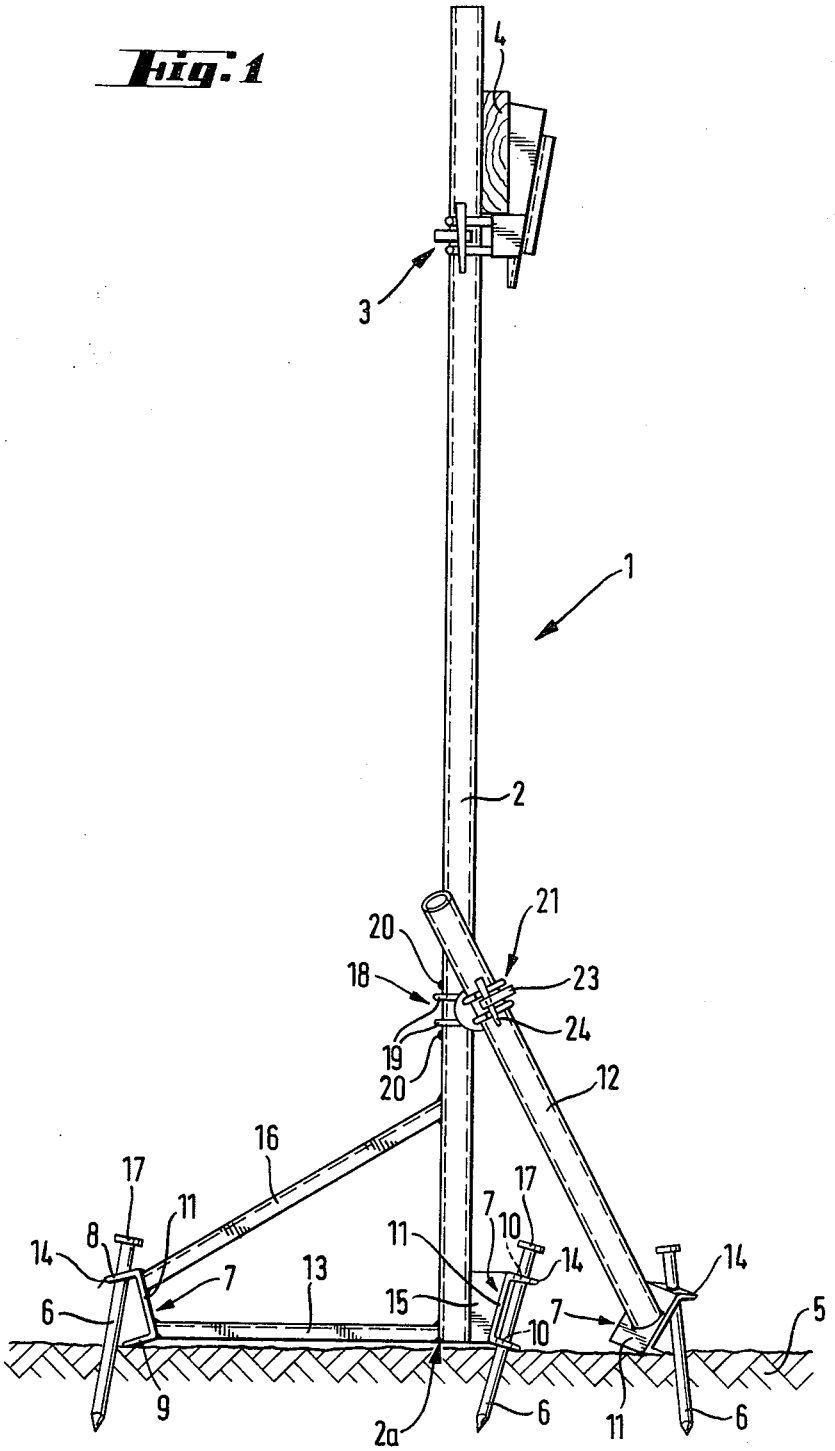
FIG. 1 is a side elevational view of a novel peg which forms part of the improved frame and is secured to the ground.

Referring first to FIG. 1, there is shown a peg 1 which is constructed, assembled and secured to the ground 5 in accordance with a first embodiment of the present invention. This peg constitutes one of several pegs which serve to support wooden laths, batter boards, beams or planks 4 which, in turn, carry nails or analogous projections for the ends of flexible lines (not shown) in the form of cords, ropes or the like.

The peg 1 comprises an upright carrier or post 2 with a vertically adjustable holder 3 for a portion of the aforementioned board 4 which extends at right angles to the plane of FIG. 1 and forms with a similar board a substantially V-shaped body at the corner of the proposed excavation site of a building or the like. The frame includes three pegs 1 at each corner of the proposed excavation to enable the lines to intersect each other within the confines of the V-shaped body formed by the illustrated board 4 and a similar board, not shown. The three pegs at each corner of the proposed or contemplated construction site are disposed at the corners of a triangle.

The peg 1 is secured to the ground 5 by several nails 6 of the type customarily employed for securing parts to the ground. Each nail 6 has an elongated shank with a pointed tip at one end and a larger-diameter head 17 at the other end. In accordance with a feature of the invention, the peg 1 comprises several substantially U-shaped end portions or legs 7 each of which has two spaced parallel flanges 8, 9 and a web 11 between and normal to the two flanges. Each of the flanges 8, 9 is formed with an opening 10 (see particularly FIGS. 4 and 5) and the opening 10 of each flange 8 registers with the opening 10 of the respective flange 9. This is indicated by the dash-and-dot lines 10' in FIGS. 2 and 3. The shank of a nail 6 which passes through the aligned openings 10 of the flanges 8, 9 is or can be parallel to the plane of the web 11. The diameters of the openings 10 exceed the diameter of the shank 6a of a nail 6 but are smaller than the diameter of a head 17. The flanges 8 and 9 of each leg 7 are at least substantially parallel to each other and normal or nearly normal to the respectively web 11. If the legs 7 are sufficiently large, each (or at least one) of their flanges 8 and 9 can be formed with two or more openings 10 for the passage of shanks 6a of discrete nails 6.

Referring again to FIG. 1, the peg 1 comprises a leg 7 which is mounted at the lower end 2a of the post 2 via an intermediate member 15, a leg 7 which is mounted on an end portion of a supporting brace 12 making an acute angle with the post 2, and a leg 7 which is mounted at the outer end of a substantially V-shaped reinforcing structure including a substantially horizontal reinforcing member 13 extending radially from the lower end 2a of the post 2 and an outwardly and downwardly sloping reinforcing member 16 which makes an oblique angle with the post 2 and an acute angle with the member 13 and is secured to (preferably is integral with) the post in a region below the locus of connection of an intermediate portion of the brace 12 to an intermediate portion of the post. The lower end 2a of the post 2 is disposed between the leg 7 on the intermediate member 15 and the leg 7 on the reinforcing members 13, 16. The legs 7 and the parts to which such legs are connected preferably consist of a weldable material (e.g., metal) so that the web 11 of each leg 7 can be welded or similarly bonded to the corresponding part, either directly (see the connection between the lower end portion of the brace 12 and the corresponding leg 7) or indirectly (see the plate-like intermediate member 15 between the lower end 2a of the post 2 and the web 11 of the corresponding leg 7). The web 11 of the leftmost leg 7 of FIG. 1 is welded to the outer end portions of both reinforcing members 13, 16 of the reinforcing structure for the peg. The mounting of each leg 7 is such that the flanges 8, 9 of the legs extend from those sides of the respective webs 11 which face away from the supports for the legs. Thus, the flanges 8, 9 of the rightmost leg 7 of FIG. 1 face downwardly and to the right, i.e., away from the lower end portion of the brace 12. The flanges 8, 9 of the median leg 7 of FIG. 1 face away from the intermediate member 15, and the flanges 8, 9 of the leftmost leg 7 of FIG. 1 face away from the adjacent end portions of the reinforcing members 13 and 16. FIG. 1 further shows that the planes of the flanges 8, 9 of all three legs 7 are parallel to or make an acute (oblique) angle with the general plane of the surface of the ground 5 (it being assumed that such surface is substantially horizontal). The advantages of such orientation of the flanges 8 and 9 relative to the surface of the ground 5 will be discussed hereinbelow.

The length of the webs 11 (as measured in a direction between the respective flanges 8 and 9) preferably exceeds the corresponding dimension of the adjacent portion of the support for the leg. Thus, and referring to the rightmost leg 7 of FIG. 1, the length of the corresponding web 11 appreciably exceeds the diameter of the brace 12 so that (if desired or necessary) those portions of the web 11 which extend laterally of and beyond the brace can be formed with one or more openings 10 (see FIG. 5) for the passage of the shank or shanks of one or more additional nails which are driven into the ground 5 to further enhance the stability of the peg 1. The web 11 of the median leg 7 of FIG. 1 can have one or more openings 10 (not specifically shown) at each side of the intermediate member 15. The utilization of pegs with legs 7 whose webs 11 have one or more openings 10 is especially desirable when a peg is to be mounted on or adjacent to a sloping terrain so that the shank of a nail 6 which is caused to pass through an opening 10 can be readily driven into the ground below an inclined surface. In fact, it happens from time to time that, in order to reach the ground 5, a nail 6 can be driven only through one or more openings 10 if the inclination of the surface of the ground is such that the nail or nails passing through the openings 10 of the flanges 8, 9 would invariably bypass the ground.

The planes of flanges 8, 9 forming part of the leftmost leg 7 of FIG. 1 make with the axis of the post 2 acute angles which are or which may be identical with the acute angles between the planes of the flanges 8, 9 on the median leg 7 of FIG. 1 and the axis of the post 2. In other words, save for the fact that the leftmost leg 7 of FIG. 1 is more distant from the post 2 than the median leg 7, these legs are or can be mirror symmetrical to each other with reference to a plane which includes the axis of the post 2 and is normal to the plane of FIG. 1.

Figures 2, 3:
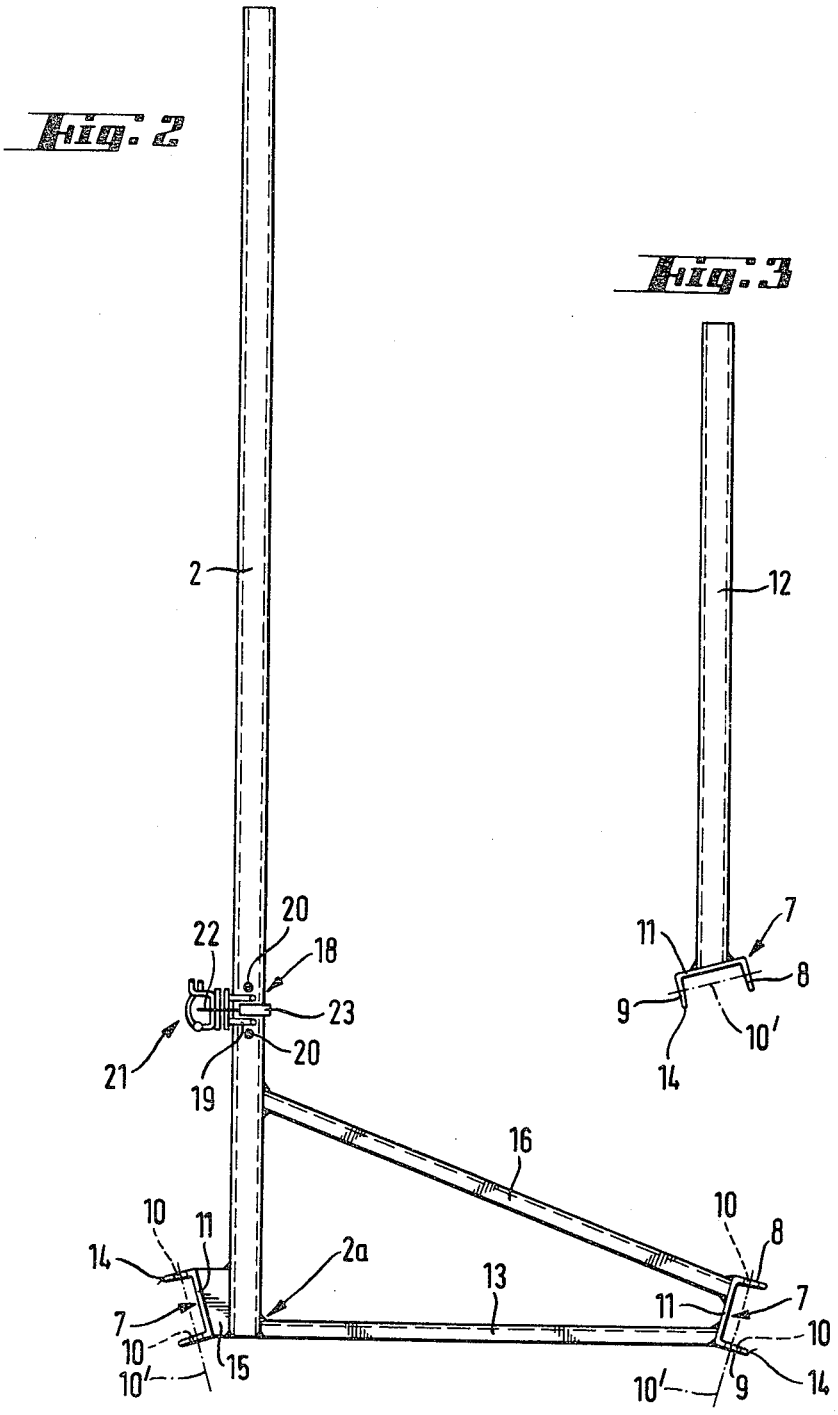
FIG. 2 is a side elevational view of a modified peg which is not secured to the ground.
FIG. 3 is a side elevational view of a brace which can be used in the peg of FIG. 1 or 2.
Figure 4:
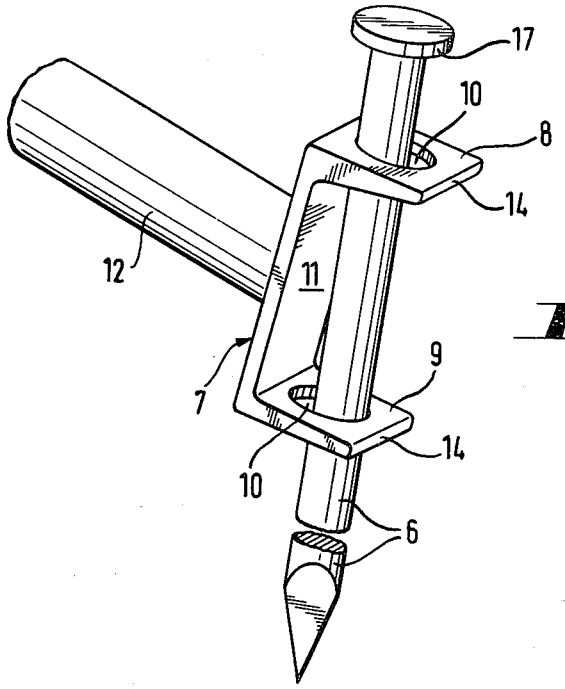
FIG. 4 is a perspective view of an end portion of a part of the peg with a nail which passes through a pair of aligned openings in the end portion.
Figure 5:
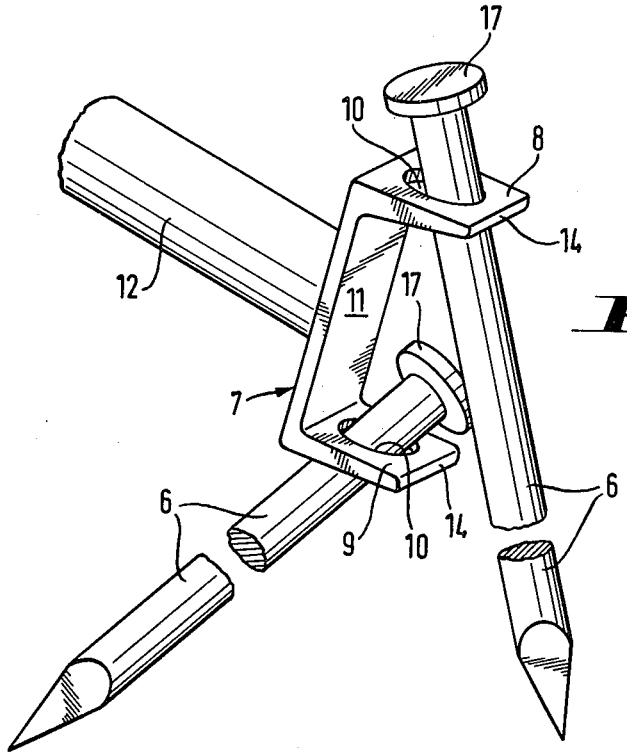
FIG. 5 is a similar perspective view of the end portion of a part of the peg but showing two mutually inclined nails each of which passes through a single opening.

FIG. 3 shows that the plane of the web 11 of the leg 7 which is welded to the brace 12 makes an oblique angle with the axis of the brace. Since the brace 12 is mounted on the post 2 in such a way that it can turn (when necessary) about its own axis, the inclination of the leg 7 on the brace 12 with reference to the surface of the ground 5 can be changed practically at will so as to ensure that the operator can drive one or more nails 6 into the ground 5 with the prospect of establishing a highly satisfactory or optimal securing action. FIG. 1 shows, by way of example, that the leg 7 on the brace 12 is held in a position in which the flange 8 is remote from the ground 5 and the flange 9 is not positively connected to but merely rests on the ground. A single nail 6 is driven through the opening 10 of the flange 8 and into the ground. The inclination of the brace 12 relative to the post 2 and the orientation of the rightmost leg 7 of FIG. 1 with reference to the axis of the brace 12 will be changed if the peg 1 is to be secured to a piece of ground having a sloping surface or if the ground includes an inclined (steep or slightly sloping) portion which is to take one or more nails passing through one or both flanges of the leg 7 on the brace 12. FIG. 4 shows that a single nail 6 can pass through the aligned openings 10 of the flanges 8 and 9 forming part of a leg 7 (on the brace 12, on the intermediate member 15 or on the reinforcing members 13, 16). FIG. 5 shows that the openings 10 of the flanges 8, 9 can be traversed by two discrete nails 6 whose shanks are inclined with reference to each other. As mentioned above, the heads 17 of the nails 6 cannot pass through the openings 10.

It is further within the purview of the invention to mount or orient one or more legs 7 in such a way that the outer edge face 14 of each of the flanges 8, 9 contacts the surface of the ground 5. For example, the median leg 7 of FIG. 1 can be secured to the lower end **2*a* of the post 2 in such a way that the plane of the web 11 of such leg is normal to the vertical axis of the post and the edge faces 14 of the two flanges 8, 9 of such leg abut against or even penetrate into the ground. One or more nails can pass through one or more openings (10) of such web in substantial parallelism with the axis of the post 2 and additional nails can be driven through the openings 10 of the flanges 8, 9 so that the axes of such additional nails are inclined relative to the axis of the post. The edge faces 14 of the flanges 8, 9 of each leg 7 are more distant from the respective carrier (2, 12, 13 and 16) for the leg than the corresponding web 11**.

The plane of the web 11 of the leg 7 which is secured to the intermediate member 15 makes an acute angle with the axis of the post 2. The locus where the plane of the web 11 of such leg 7 intersects the axis of the post 12 is located at a level below the lower end **2*a* of the post, i.e., below the surface of the ground 5 when the peg 1 is mounted in a manner as shown in FIG. 1. The intermediate member 15 extends laterally from the post 2 and is triangular, trapezoidal or trapeziform, i.e., its width decreases in a direction toward the lower end 2*a*. Since the nail 6 which extends through the openings 10 of flanges 8, 9 of the leg 7 on the member 15 of FIG. 1 is inclined with reference to the axis of the post 2**, its retaining and anchoring action is even more satisfactory than that of a nail which is parallel to the post.

The horizontal reinforcing member 13 is integral with the lower end **2*a* of and extends at right angles to the post 2. The length of the reinforcing member 13 is a fraction of the length of the post 2. In cooperation with the downwardly and outwardly inclined reinforcing member 16, the horizontal member 13 ensures that the leftmost leg 7 of FIG. 1 stiffens the peg 1 and reduces the likelihood of accidental changes in inclination of the post 2 when the peg 1 is in actual use. The peg 1 is in what can be called three-point contact with the ground 5, and the three points of contact (namely, the three legs 7) are disposed at the corners of a relatively large triangle so that the post 2 is highly unlikely to overturn even if its upper portion is subjected to pronounched stresses acting at right angles to its axis. The brace 12 is optional, i.e., the post 2 can be held in a desired position by two legs 7, especially if each of the two legs is connected to the ground by several nails, e.g., in a manner as shown in FIG. 5**.

The openings 10 in the flanges 8, 9 of a leg 7 need not be in exact alignment with each other. Thus, if it is contemplated to use several nails 6, e.g., in a manner as shown in FIG. 5, the opening 10 in the flange 8 can be offset relative to the opening 10 in the flange 9 so as to simplify the introduction of nails into both openings and to increase the number of positions and orientations in which the nails can be maintained during penetration into the ground. The inclination of a nail 6 passing through the openings 10 of flanges 8, 9 of the leg 7 on the reinforcing members 13 and 16 is preferably analogous to that of a nail passing through the openings of flanges 8, 9 of the leg 7 which is secured to the member 15, i.e., the axis of such nails intersect the axis of the post 2 at a level below the lower end **2*a* of the post. This ensures that the just discussed nails provide a substantially dovetailed anchoring structure for the post 2 and the outer end portions of the reinforcing members 13 and 16**.

If a leg 7 is secured to the ground 5 by resorting to several nails 6 and by inserting the nails in a manner as shown in FIG. 5, the lower nail 6 is inserted into the opening 10 of the lower flange 9 and driven into the ground ahead of the other nail. As explained above, the diameters of the openings 10 preferably exceed the diameters of the shanks **6*a*, as long as the openings 10 do not allow for passage of the heads 17. If the heads 17 are sufficiently large, the diameters of the openings 10 in the flanges 8 and 9 can exceed the diameters of the shanks 6*a* to such an extent that the nails 6 shown in FIG. 5 can make an angle of up to 90 degrees or even more. Of course, it is also possible to use two parallel or nearly parallel nails 6 for connection of any one of several legs 7 to the ground. For example, a second nail, parallel to the nail 6 passing through the upper flange 8 of the leftmost leg 7 of FIG. 1, can be driven through the opening of the lower flange of such leg in parallelism with the illustrated nail to further strengthen the connection between the outer end portions of the reinforcing members 13, 16 and the ground 5. The same holds true for the leg 7 at the lower end of the brace 12 shown in FIG. 1. The single nail 6 which connects the median leg 7 of FIG. 1 to the ground can be replaced with several (e.g., two) nails. All that is necessary is to insert the illustrated nail 6 into the opening of the lower flange of the leg 7 on the member 15 and to use a second nail for connection of the upper flange to the ground. The two nails are then inclined relative to each other, e.g., in a manner as shown in FIG. 5**.

The coupling which secures the upper portion of the brace 12 to an intermediate portion of the post 2 comprises a substantially annular portion or collar 18 which surrounds the post 2 and is preferably held against axial movement on the post, i.e., at a fixed distance from the lower end 2*a*. To this end, the post 2 can be formed with two projections 20 (e.g., spots of weldant) which are adjacent to the end faces of the collar 18. The latter is assembled of two ring-shaped clamps 19 which surround a portion of the post 2 between the projections 20. A locking device 23 can tighten the clamps 19 around the post 2. The coupling further comprises a second collar 21 whose ring-shaped clamps surround the brace 12 and are connected to the collar 18. The collar 21 serves as a means for releasably securing the brace 12 to the post 2 through the medium of the collar 18. Means (not specifically shown but corresponding to the device 23) is provided to tighten the clamps of the collar 21 to the brace 12 at a desired distance from the corresponding leg 7. The brace 12 can be separated from the post 2 in response to loosening of the clamps which constitute the collar 21. The collars 18 and 21 can turn relative to each other so that an operator can change the angle between the axes of the post 2 and brace 12. The axis about which the collar 18 can turn relative to the collar 21 or vice versa is shown at 22 (see FIG. 2); such axis extends radially of the post 2 and radially of the brace 12. The length of that portion of the brace 12 which extends downwardly beyond the collar 21 will be changed (reduced or increased) if the leg 7 on the brace 12 is to be secured to a piece of ground which slopes upwardly or downwardly, i.e., depending upon whether the leg 7 on the brace 12 must be fixed to the ground 5 at a level above or below the leg 7 on the member 15.

As illustrated in FIG. 2, the ring-shaped clamps 19 of the collar 18 for the post 2 and/or the ring-shaped clamps of the collar 21 can resemble suitably curved prongs of a bifurcated element. The locking device 23 can deform the prongs or clamps 19 into satisfactory frictional engagement with the peripheral surface of the post 2 between the projections 20. This locking device can be held in operative position by a wedge 24 or the like. The coupling between the post 2 and brace 12 may constitute a commercially available prefabricated unit which should be capable of permitting attachment or separation of the brace 12, axial shifting of the brace, as well as movements of the brace about the axis of the post and/or about an axis which is normal to the axis of the post.

The post 2 can be separably and adjustably coupled with two or more discrete braces. This renders it possible to omit the reinforcing members 13, 16 and the leg 7 at the outer ends of such reinforcing members.

The aforedescribed peg 1 (or each of the aforediscussed modifications of the illustrated peg) is fully capable of reliably supporting a board 4 or another suitable carrier for nails or studs to which the lines are attached to define that area which must be dug up prior to pouring a foundation, building a basin, digging a channel and/or prior to analogous operations. The provision of one or more adjustably mounted braces 12 is especially desirable when the surface of the ground is not flat, i.e., when a peg is to be secured to sloping or partly even and partly sloping terrain. The provision of legs with openings for two or more nails 6 is desirable because the nature of the ground may be such that a rock below one of the openings 10 will not permit penetration of a nail but the ground below the other openings or openings of a leg 7 will permit such penetration. Thus, plural openings practically guarantee the possibility of adequate or highly satisfactory attachment of a leg 7 to the ground.

While it is possible to design the couplings of FIGS. 1 and 2 in such a way that the sleeve 18 can slide lengthwise of the post 2 (by omitting at least one of the projections 20), the illustrated coupling has been found to be quite satisfactory and sufficiently versatile to permit all necessary adjustments of the brace 12 with respect to the post. The projections 20 can be replaced with detachable screws or analogous removable or detachable projections so that the collar 18 can be shifted lengthwise of or detached from the post 2.

A further important advantage of U-shaped legs 7 is that each nail 6 which connects a leg to the ground remains accessible between the flanges 8, 9 or between such flanges as well as above the upper flange. This is often important and desirable, for example, if the peg is to be detached from the ground with little loss in time and by resorting to simple and readily available tools. A nail which passes through a tubular leg of conventional design is accessible only in the region of its head.

The openings 10 may but need not be circular, as long as they permit the shanks to pass while the flanges 8, 9 and the webs 11 intercept the heads 17 of the nails 6.

The legs 7 can be manufactured at a reasonable cost by severing a prefabricated (e.g., rolled or extruded) U-shaped or C-shaped metallic beam at regular intervals depending on the desired width of the flanges 8, 9 and the respective webs 11. The area of each web 11 and the weight of each leg 7 is preferably selected with a view to further enhance the stability of a properly installed peg. As explained above, the edge face 14 of at least one of the flanges 8, 9 on a properly secured leg 7 contacts the ground, and both flanges of a leg can penetrate into the ground to further reduce the likelihood of any changes of orientation or complete overturning of a peg. The force with which the peg is secured to the ground can be increased still further by burying a properly secured leg 7 in the ground. For example, the leg 7 on the brace 12 can be buried in sloping terrain to thus assist the action of one or more nails in holding the leg on the brace against movement away from the ground.

The distance between the collar 18 (between the projections 20) on the median portion and the lower end 2*a* of the post 2 can be readily selected in such a way that the locus of the collar 18 is the optimum position (from the statical point of view) for attachment of the brace 12 regardless of the selected distance between the collar 18 and the leg 7 on the brace.

The post 2 preferably constitutes a round piece of metallic tubing so that, when the clamps 19 are not locked to the tube, the entire coupling for the brace 12 can turn around the axis of the post. Alternately, only that portion of the post 2 which is located between the projections 20 may have a cylindrical peripheral surface to allow for movements of the brace 12 about the axis of the post. The ability of the brace 12 to turn about the aforementioned axis 22 further contributes to versatility of the coupling and enables a worker to properly secure the peg to flat or uneven ground.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A frame for setting up lines preparatory to excavation at building sites or the like comprising:

(a) a post;

(b) at least one leg adjacent to the ground for connecting said post to the same, said leg being substantially U-shaped and including a pair of overlapping substantially parallel flanges which are connected by a web and are disposed in respective planes, said flanges being substantially perpendicular to said web and each of said flanges being provided with an opening having an axis which is generally normal to the plane of the respective flange, said leg being arranged such that said flanges are parallel to or make an acute angle with the ground, said web being fixedly secured adjacent one end of said post and defining an acute angle with respect to the longitudinal axis of said post; and (c) securing means for securing said leg to the ground, said securing means including at least one securing member extending with clearance through at least one of said openings and into the ground.

2. The frame of claim 1, further comprising a brace having a first portion connected with said post and a second portion connected with said leg.

3. The frame of claim 1 wherein said web is bonded to said one end.

4. The frame of claim 1, further comprising a brace having a first portion connected with said post and a second portion permanently connected with said web.

5. The frame of claim 4, wherein said web is bonded to said second portion of said brace.

6. The frame of claim 1, further comprising a brace having a first portion connected to said post and a second portion connected to said leg, said flanges having edge faces remote from said post and said web being nearer to said second portion of said brace than said edge faces.

7. The frame of claim 1, wherein said post is substantially upright when said leg is connected to a piece of ground having a substantially horizontal surface and said flanges are disposed in planes making an oblique angle with such horizontal surface.

8. The frame of claim 1, wherein said post is elongated and said web is disposed in a plane making an oblique angle with the longitudinal direction of said post.

9. The frame of claim 1, further comprising an elongated brace having a first portion connected to said post and a second portion connected to said leg, said web being disposed in a plane making an oblique angle with the longitudinal direction of said brace.

10. The frame of claim 1, wherein said post is elongated and has an upper end and a lower end; and further comprising means for connecting said web to said lower end, said web being disposed in an additional plane making an oblique angle with the longitudinal direction of said post and said connecting means tapering in a direction from said upper toward said lower end of said post.

11. The frame of claim 10, wherein said flanges are substantially normal to said web and said openings are at least substantially aligned with each other, the shank of a nail which passes through such aligned openings being substantially parallel to said additional plane.

12. The frame of claim 10, wherein said connecting means includes a substantially plate-like intermediate member extending laterally from the lower end of said post and said width of said intermediate member, as considered in the longitudinal direction of said post, decreases in a direction from said upper toward said lower end of said post.

13. The frame of claim 1, further comprising reinforcing means including a first portion secured to said post and a second portion remote from said post and connected with said web.

14. The frame of claim 13, wherein said reinforcing means includes an elongated reinforcing member which is integral with said one end of said post, said reinforcing member extending substantially radially of said post.

15. The frame of claim 1, wherein said post is elongated and wherein said one end comprises a lower end; and further comprising reinforcing means including a first elongated reinforcing member having a first end portion rigid with said lower end and a second end portion rigid with said web, and a second elongated reinforcing member having a first end portion rigid with said post and a second end portion rigid with said web.

16. The frame of claim 15, wherein said reinforcing members make an acute angle and the distance therebetween increases in a direction from said web toward said post.

17. The frame of claim 1, wherein said openings are aligned with each other so that the shank of a nail can extend through such aligned openings.

18. The frame of claim 1, wherein said openings are aligned with each other and said post is elongated and wherein said one end comprises a lower end secured to said leg, the axis of the shank of a nail which passes through said aligned openings intersecting the axis of said post in a region which is located below said lower end when said leg is secured to the ground.

19. The frame of claim 1, wherein said post is elongated; and further comprising reinforcing means rigid with and extending laterally from said post, said reinforcing means having a portion remote from said post and rigid with said web, and said openings being aligned with each other, the axis of the shank of a nail which passes through such aligned openings and into the ground intersecting the axis of said post at a level below the surface of the ground.

20. The frame of claim 1, wherein said nail has a head with a diameter such that it cannot pass through said openings, said openings being dimensioned to receive said shank with at least some clearance.

21. The frame of claim 1, further comprising a brace having a first portion adjacent to and a second portion remote from said post, said leg being connected with said second portion of said brace, and means for coupling said first portion of said brace to said post.

22. The frame of claim 21, wherein said one end of said post comprises a lower end and said coupling means is disposed at a fixed distance from said lower end.

23. The frame of claim 21, wherein said coupling means comprises means for releasably securing said brace to said post.

24. The frame of claim 21, wherein said coupling means includes means for releasably clamping said brace so that the latter is movable lengthwise with respect to said post on disengagement of said clamping means.

25. The frame of claim 21, wherein said coupling means includes a portion which is rotatable on said post and means for releasably locking said rotatable portion in a selected angular position.

26. The frame of claim 25, wherein said post includes means for holding said rotatable portion against movement in the longitudinal direction of said post.

27. The frame of claim 26, wherein said holding means includes two projections integral with said post and flanking said rotatable portion.

28. The frame of claim 21, wherein said coupling means includes a first portion releasably engaging said post and a second portion releasably engaging said brace, said portions being turnable relative to each other about an axis extending substantially radially of said post.

29. The frame of claim 21, wherein said coupling means includes a first portion surrounding said post and a second portion surrounding said brace and connected with said first portion, at least one of said first and second portions including a bifurcated member straddling brace or post, a locking device for urging said bifurcated member against said brace or post, said locking device being movable between operative and inoperative positions, and means for holding said locking device in said operative position.

30. The frame of claim 1, further comprising a board, and means for adjustably holding said board on said post.

31. The frame of claim 1, wherein said securing member comprises a nail having a shank which extends through said one opening and into the ground.

* * * * *